US007021819B2

(12) United States Patent
Schmiedchen

(10) Patent No.: US 7,021,819 B2
(45) Date of Patent: Apr. 4, 2006

(54) TIMEPIECE INCLUDING A STRIKING WORK

(75) Inventor: Christian Schmiedchen, Reichstädt (DE)

(73) Assignee: Glashutter Uhrenbetrieb GmbH, Glashutte/Sachs (CH)

( * ) Notice: Subject to any disclaimer, the term of this patent is extended or adjusted under 35 U.S.C. 154(b) by 239 days.

(21) Appl. No.: 10/472,119

(22) PCT Filed: Mar. 21, 2001

(86) PCT No.: PCT/EP01/03344

§ 371 (c)(1),
(2), (4) Date: Sep. 22, 2003

(87) PCT Pub. No.: WO02/077724

PCT Pub. Date: Oct. 3, 2002

(65) Prior Publication Data

US 2004/0090869 A1 May 13, 2004

(51) Int. Cl.

| | |
|---|---|
| ***G04C 21/00*** | (2006.01) |
| ***G04B 3/00*** | (2006.01) |
| ***G04B 5/00*** | (2006.01) |
| ***G04B 23/00*** | (2006.01) |

(52) U.S. Cl. ..... 368/147; 368/206; 368/213; 368/260

(58) Field of Classification Search ..... 368/72, 368/139, 142, 147, 206, 207, 213–215, 243, 368/260, 269–271, 315

See application file for complete search history.

(56) References Cited

U.S. PATENT DOCUMENTS

| | | | | | |
|---|---|---|---|---|---|
| 526,871 | A | * | 10/1894 | Schisgall | 368/213 |
| 1,535,684 | A | * | 4/1925 | Wilson et al. | 368/143 |
| 1,893,909 | A | * | 1/1933 | Schild | 368/213 |
| 1,931,277 | A | * | 10/1933 | Wenger et al. | 368/213 |
| 2,652,684 | A | * | 9/1953 | Bridevaux | 368/213 |
| 2,903,844 | A | * | 9/1959 | Paul | 368/147 |
| 3,537,254 | A | * | 11/1970 | Masanori | 368/147 |

FOREIGN PATENT DOCUMENTS

| | | |
|---|---|---|
| CH | 527 455 | 1/1972 |
| DE | 41 474 | 5/1887 |
| FR | 1 106 848 | 12/1955 |
| FR | 1 421 930 | 3/1966 |
| FR | 2 302 473 | 9/1976 |

OTHER PUBLICATIONS

International Search report completed Aug. 2, 2001 and mailed Aug. 10, 2001 in PCT/EP 01/03344.

* cited by examiner

*Primary Examiner*—Vit W. Miska
(74) *Attorney, Agent, or Firm*—Griffin & Szipl, P.C.

(57) ABSTRACT

A timepiece including a clockwork movement for measuring the time, and a striking work actuated by a barrel with a motor spring independent of the clockwork movement, this timepiece also including mechanical control means capable of being actuated manually to trigger the striking work, wherein the barrel is wound by means of a winding bar that ends, at its free end, in a toothed sector or rack and is kinematically connected to a winding push-button on the one hand, and to the motor spring of said striking work on the other hand.

25 Claims, 6 Drawing Sheets

TIMEPIECE INCLUDING A STRIKING WORK

This is a National Phase Application in the United States of International Patent Application No. PCT/EP01/03344 filed Mar. 21, 2001. The entire disclosure of the above patent application is hereby incorporated by reference.

BACKGROUND OF THE INVENTION

The present invention concerns a timepiece including a striking work mechanism. It relates to clocks, chronographs and other clockwork-movements. It concerns more particularly portable clockwork-movements, i.e. those that can be put in a pocket or attached to the wrist.

Timepieces that emit an acoustic signal at the end of a predetermined and adjustable time are already known. These timepieces conventionally include a clockwork-movement measuring in particular the time and a striking work whose triggering is controlled by the movement.

The timepieces of the aforecited type are designed for example for timing a limited parking time of a vehicle, and remind the user with ringing or a gong that the parking time has run out.

The timepiece according to the invention is intended amongst others, but not exclusively, for such an application.

A first category of timepieces concerns the clocks, alarm clocks and other wristwatches, which are provided with a striking work actuated by the same spring barrel as that which supplies the timekeeping device with mechanical energy. These mechanisms thus include a single spring, which, during a first operating period, operates the clockwork-movement, and during a second operating period, provides the energy necessary for the warning signal to operate. Such mechanisms are essentially characterised in that, between the moment of winding and setting the time and the moment that the alarm is triggered, the barrel drum actuates the clockwork-movement, whereas at the moment the alarm is triggered, one hammer is released, which strikes a gong of any appropriate type, said hammer then being actuated by the same barrel drum, but the clockwork-movement spring acting, owing to a special mechanism, via a detent movement in the opposite direction.

As will be easily understood, mechanisms of the type described hereinbefore are extremely complex and thus expensive to manufacture. They require a large number of special parts that are not available on the market and that therefore have to be made to measure. These mechanisms are also very fragile. Finally, since the same motor spring ensures both the working of the clockwork-movement and that of the striking work mechanism, the force of the spring is not used solely to measure the time, which limits the power reserve of the watch and requires its user to wind it regularly, and more often the more he uses the alarm device.

In order to overcome these drawbacks, a second type of watch has been proposed, fitted with a striking work actuated by an auxiliary barrel spring independent of the barrel spring supplying energy to the timekeeper. Surprisingly, it has been observed that addition, in a conventional clockwork-movement, of a second movement distinct from the first and reserved solely for the proper working of the alarm mechanism, was not accompanied by a prohibitive increase in manufacturing costs, insofar as such a mechanical construction allows the general kinematics of the clockwork movement to be substantially simplified.

Among the problems that remain to be resolved however, one concerns the triggering of the timer function and winding of the motor spring of the auxiliary barrel whose force is used to actuate the striking work. Indeed, to the Applicant's knowledge, the only technical solutions currently available consist of two distinct push-buttons, one of these push-buttons being used to actuate the countdown of time after the period at the end of which the warning signal has to be emitted has been selected, whereas the other push-button is used to wind the motor spring of the striking work. This multiplication of push buttons tends to increase the cost price of the timepiece and is detrimental to its aesthetic appearance.

According to a variant, the winding crown which, primitively, is for winding the single movement that measures the time, may also be used to wind the striking work. Such an arrangement, however, again considerably complicates the construction of the watch and, due to the use of special parts, which are not available on the market, that it involves, inevitably leads to a significant increase in manufacturing costs.

Another known solution for winding the motor spring used to drive the striking work consists in using a slide-bar, i.e. a mechanism which moves with friction in or on a slide way, accessible from outside the watchcase. The winding of the aforementioned motor spring results from actuation of the slide-bar whose movement is transmitted to a rack meshing with the wheel of the shaft that supports the barrel to which said motor spring is hooked. The slide-bar is conventionally acted upon by a bolt that is manoeuvred with a finger and which is used to wind the striking work motor spring. Such a device practically is no longer used at the present time since, unless particularly complex and thus expensive measures are taken, it irreparably damages the water resistance of the watchcase to which it is fitted.

SUMMARY OF THE INVENTION

It is thus an object of the present invention to overcome the aforementioned drawbacks, in addition to others, by proposing a timepiece including a striking work, the advantage of which lies in the operating security of said striking work, owing to the use of movements that can be mass produced and, consequently, of a more advantageous cost price, given the simplicity of the modifications to be made to the basic movement.

The present invention therefore concerns a timepiece including a clockwork movement for measuring the time, and a striking work actuated by a motor spring barrel independent of the clockwork movement, this timepiece also including mechanical control means capable of being manually actuated to trigger the striking work, characterised in that the barrel is wound by means of a winding bar, which ends, at its free end, in a rack connected kinematically to a winding push-button on the one hand and to the motor spring of said striking work, on the other hand.

Owing to these features, the present invention provides a timepiece fitted with an acoustic alarm mechanism based on a conventional clockwork movement, capable of emitting a warning signal at the end of a predetermined time period. The push-button used within the scope of the invention is also a conventional push-button, mass produced and thus inexpensive, the installation of which does not require any modification of the clockwork movement and does not alter the water resistance, for example of a case in which said clockwork movement is arranged.

Moreover, since the striking work is actuated by an auxiliary spring barrel independent of the movement carrying out the time measurement, the construction of the timepiece according to the invention is greatly simplified and thus less expensive. Another advantage can be seen in the fact that, because of the independence between the warning or alarm mechanism and the clockwork movement, the adjustment and working of said alarm mechanism cannot disturb or adversely affect the other functions of said clockwork movement. Thus, the entire force of the motor spring is used solely for actuating the striking work, whereas the spring that assures the operation of the clockwork movement is entirely devoted to that task. Consequently, the power reserve of the watch is not run down by the operation of the alarm mechanism.

According to yet another advantage of the present invention, the motor spring for actuating the striking work is wound by means of a winding bar, which ends, at its free end, in a toothed sector or rack kinematically connected to the winding push-button on the one hand, and to the motor spring of the striking work on the other hand.

Owing to this feature, a conventional push-button, commonly available on the market, can be used, mounted in a water resistant manner, for example on a watchcase, and whose travel, typically of the order of a millimetre, is sufficient to wind the motor spring of the alarm mechanism. Moreover, the kinematic link between the push-button and the striking work motor spring allows said striking work, like said push-button, to be arranged in any location in the watchcase, for example as a function of requirements dictated by the size of the clockwork movement or for considerations of an aesthetical nature. It is thus no longer necessary, as is sometimes the case in the state of the art, to provide the push-button in the zone where the strands of the bracelet or wristband are attached to the watchcase, an arrangement which makes it particularly difficult to actuate the push-button.

BRIEF DESCRIPTION OF THE DRAWINGS

Other features and advantages of the present invention will appear more clearly upon reading the following detailed description of an example embodiment of the timepiece according to the invention, this example being given by way of purely illustrative and non-limiting example, in conjunction with the annexed drawings, in which.

DETAILED DESCRIPTION OF THE INVENTION

The present invention proceeds from the general inventive idea, which consists in using a single push-button for winding a motor spring whose force is used solely for actuating an alarm or warning mechanism. This push-button is of the type commonly available on the market, and can be mounted very easily in a water resistant manner, for example on a watchcase fitted with said alarm mechanism. The invention thus answers market demand for a water resistant winding push-button, that does not adversely affect the aesthetic appearance of the watch and is easy to install.

The present invention will be described with reference to a timepiece of the wristwatch type. It is, however, clear that the present invention is not limited to such an application and that it could advantageously be used within the scope of any other application requiring a period of time to be counted down and the end of the countdown to be indicated by emission of an acoustic signal.

Figure 1:
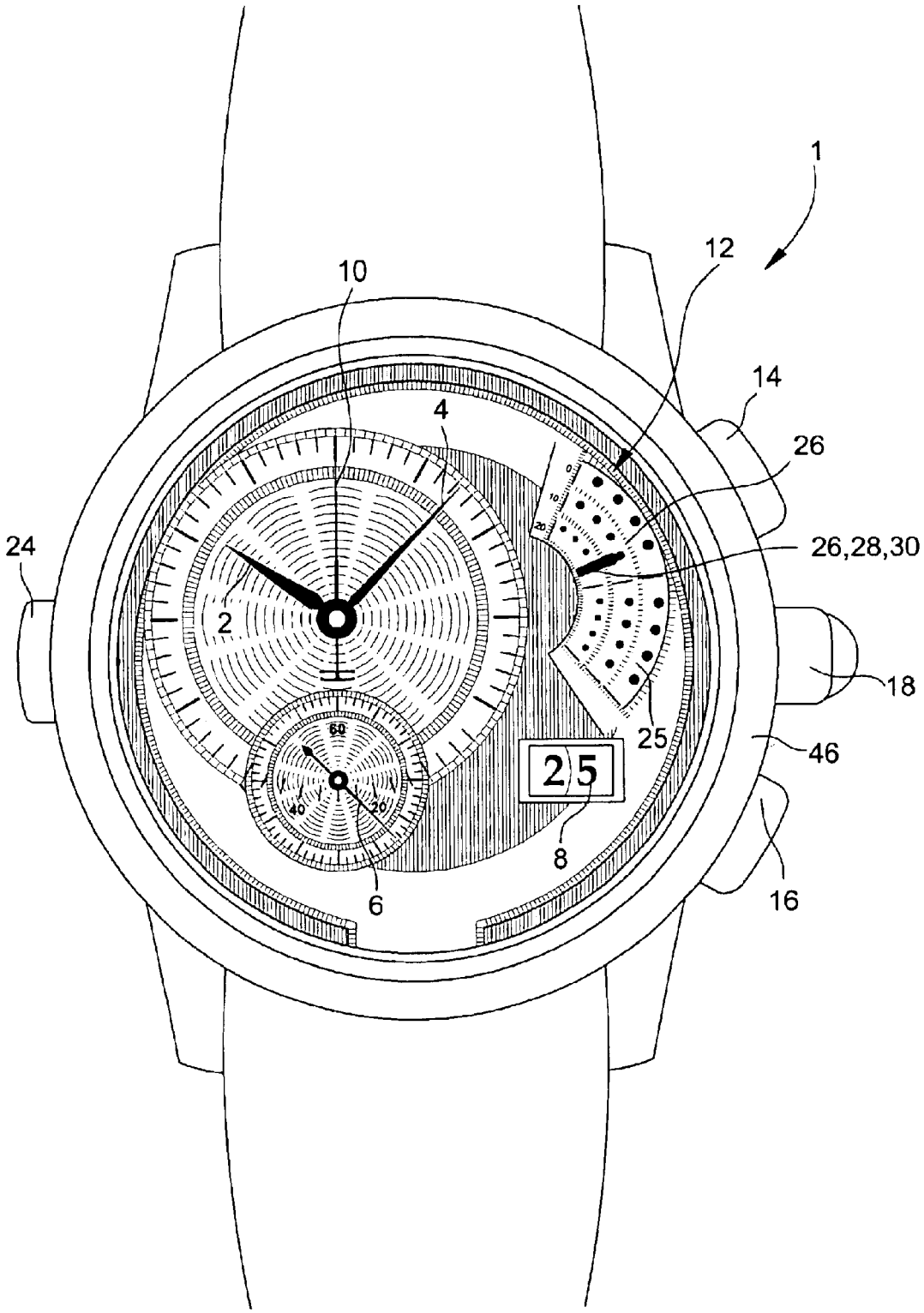
FIG. 1 is a plan view of a timepiece containing the striking work in accordance with the present invention.

A timepiece of the wristwatch type including a striking work according to the present invention is shown in a plan view in FIG. 1, designated by the general reference numeral 1. This timepiece 1 includes timekeeping hands, namely an hour hand 2, a minute hand 4 and a small second hand 6. A large aperture date device 8 completes the timekeeping mechanism. Timepiece 1 taken by way of example here further includes a chronograph function with a second hand 10 and a minute counter 12. Hand 10 and counter 12 are started and stopped by means of a first push-button 14, whereas a second push-button 16 resets said indicators 10 and 12 to zero. A crown 18, depending on the axial positions into which it is brought, allows the timepiece to be wound, the calendar to be set and hands 2, 4 and 6 of the timekeeping mechanism to be set to the correct time.

In timepiece 1 shown in FIG. 1, minute counter 12 is also used as a timer or countdown counter, crown 18 being used to correct the time set for the period of time to be counted down. The countdown counter is started and a part 20, which forms the barrel and actuates a striking work 22 indicating audibly to the person wearing watch 1 the end of the countdown, is wound simultaneously by pressing on a third push-button 24. As shown in FIG. 1, counter-timer 12 includes a dial 25 with three concentric scales each of ten minutes and over each of which a hand of different length 26, 28 and 30 travels, only one hand being visible in FIG. 1.

Figure 2:
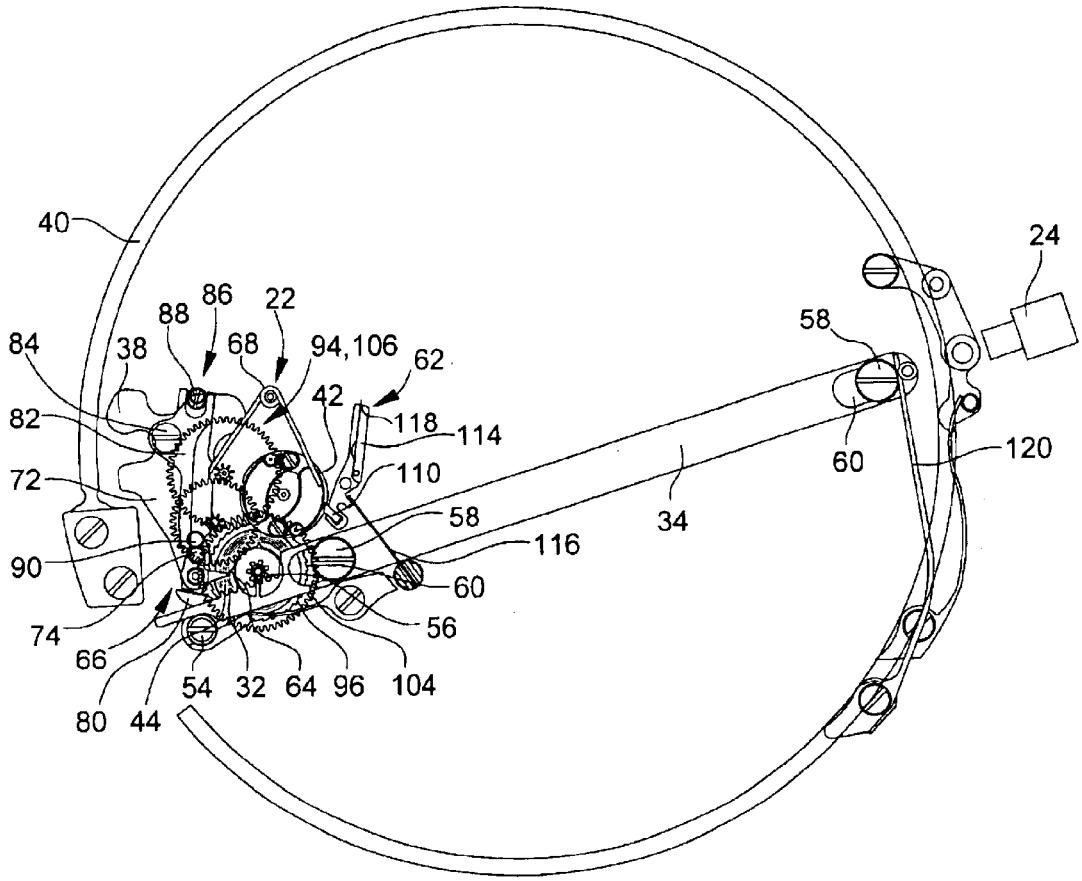
FIG. 2 is a plan view of the striking work arranged between a winding push-button and a strike train.

As FIG. 2 and the following Figures show, the timepiece includes a striking work 22 actuated by the aforementioned barrel 20. Barrel 20 is actuated by a toothed sector or rack 32 made on a bar 34 ending in the control and winding push-button 24. The barrel 20 assembly, which will be described in detail hereinafter, carries at least one snug 36 (in the examples shown in the Figures, these snugs are preferably three in number), which actuates a strike hammer 38 that strikes a gong 40 of any appropriate type. This assembly drives striking work 22, which here includes three wheel sets, including one end wheel set 42.

According to the present invention, and as already mentioned hereinbefore, striking work 22 can be wound independently of the working of the clockwork movement (not shown) by pressing on push-button 24, which causes a motor spring 44 to be wound, whose entire force is used solely for actuating striking work 22.

For this purpose, motor spring 44 is wound by means of winding bar 32, which ends at its free end in a toothed sector 32, preferably a rack. Winding bar 34 is kinematically connected to winding push-button 24 on the one hand, and to motor spring 44 of striking work 22, on the other hand.

Owing to this particularly advantageous feature of the invention, striking work 22 can be disposed anywhere in case 46 of timepiece 1, for example to take account of requirements linked to the size of the clockwork movement or for reasons of an aesthetical nature.

It will also be understood that winding push-button 24 is of the type commonly used in the field of the watchmaking industry. It is thus mass produced and available at a more advantageous price. Moreover, it is remarkably easy to mount on case 46 of watch 1 and does not in any way alter the water resistance of said watch 1.

Finally, since striking work 22 is actuated by a motor spring 44 independent of the movement that measures the time, it is an extremely simple, robust and thus reliable mechanism.

Motor spring 44 is wound inside barrel 20, hooked via its outer turn 48 onto said barrel 20, and to a barrel shaft 50 via its inner turn 52. Advantageously, barrel 20 is freely rotated about its shaft 50 when it is mounted on a plate of the movement, so as to impart an appropriate initial tension to motor spring 44, then it is stopped definitively on the plate after mounting by means of a holding member 54, such as, for example, a click. The spring is thus pre-tightened during assembling of striking work 22, such that the travel of push-button 24, which is typically of the order of a millimetre, is sufficient to wind said spring 44. Of course, according to an alternative embodiment, one could also use a special motor spring, which would be mounted slack in barrel 20 and sized so as to become suitably taut via the effect of pressure on push-button 24, to be capable then of providing a suitable force to striking work 22. This would nonetheless means that a spring not immediately available in the watch-manufacturing field would have to be used.

In order to be able to wind motor spring 44 via winding bar 24, a rack pinion 56 is provided. This pinion 56 forms the drive member for striking work 22. Fixedly mounted on the shaft of barrel 50, it meshes with rack 32 made on said winding bar 34. Winding bar 34 extends along a direction parallel to the movement of push-button 24 and is preferably aligned on the longitudinal direction thereof. In order to move bar 34 in translation when push-button 24 is actuated, bar 34 is associated with translation guide means. In the illustrated example these guide means include two studs 58, which penetrate respective oblong holes 60 made in said bar 34. Driven in rotation by rack 32, pinion 56 rotates, transmitting its rotational movement to the barrel shaft 50. Since motor spring 44 is fixedly mounted via its two ends 48 and 52 respectively to barrel 20 and to barrel shaft 50, it tightens and stores energy that it will later return to striking work 22 when it unwinds.

According to the invention, a trigger mechanism 62, which will be described in more detail hereinafter, is disposed between striking work 22 and the clockwork movement in order to prevent said striking work 22 from operating before the end of the countdown. In other words, motor spring 44 can only unwind after end wheel set 42 of striking work 22 has been released by the aforementioned trigger mechanism 62.

A drive wheel 64 is mechanically coupled to barrel shaft 50. When motor spring 44 unwinds, this wheel 64 actuates strike hammer 38, which then strikes gong 40, which causes the emission of one or more successive acoustic signals. More precisely, drive wheel 64 has a multiplicity of snugs 36 (three in number in the Figures) which, when motor spring 44 unwinds, co-operate with a tipping mechanism 66 causing hammer 38 to move back against the return force of a spring 68 and, consequently, the abrupt movement of said hammer 38 forwards against gong 40.

The aforementioned tipping mechanism 66 includes a click 70 pivotally mounted on lever 72 of hammer 38. This click 70 has the peculiarity of being able to slide on the snug(s) 36 of drive wheel 64 when the latter rotates clockwise during winding of motor spring 44. In other words, when motor spring 64 is being wound, click 70 is not acting on hammer 38, i.e. it does not tip the latter. Conversely, when motor spring 44 is let down, drive wheel 64 rotates anti-clockwise and causes click 70 to pivot via its snugs 36. Said click 70, then abutting against a pin 74 secured to strike hammer 38, communicates its tipping movement to the latter. In order to achieve this result, click 70 has to include two teeth 76 and 78 angularly spaced and rigidly connected to each other. The first tooth 76 cooperates with snugs 36 of drive wheel 64, while second teeth 78 comes to rest on pin 74 when motor spring 44 is let down and communicates its tipping movement to strike hammer 38.

In the example shown in the Figures, snugs 36 are three in number, regularly spaced on the external perimeter of drive wheel 64. This means that hammer 38 will strike gong 40 three times and thus produce three successive strikes at regularly spaced successive time intervals. Of course, according to a variant, snugs 36 could be irregularly spaced, two of snugs 36 could, for example, be close to each other, whereas the third could be at a greater distance from the first two. In such case, the person wearing watch 1 would hear two quasi-simultaneous bell rings and a third bell ring further away.

Advantageously, click 70 is held in elastic contact with drive wheel 64 by means of a holding spring 80 fixedly mounted on the clockwork movement of watch 1.

It was seen hereinbefore that in order to be able to strike gong 40, strike hammer 38 has to be tipped via drive wheel 64 fitted with its snugs 36 against the elastic return force of a spring 68. Once whichever of snugs 36 is meshed with click 70 has passed said click 70, hammer 38 is free to tip. Spring 68 then unwinds, and abruptly projects said hammer 38 against gong 40. A mechanism allowing hammer 38 to return to its rest position now has to be provided.

According to the invention, hammer 38 is returned to its rest position by a spring 82. As the Figures show, spring 82 is fixedly mounted at at least one point on the clockwork movement. More precisely, spring 82 is fixed to the clockwork movement by a first screw 84 and has a notch 86 into which a second screw 88, also secured to the movement, projects. Notch 86 is intended to take up a play and compensate, if necessary, poor alignment of spring 82. As can be seen in the Figures, a pin 90 is fixedly mounted on lever 72 of strike hammer 38. When said hammer 38 is projected forwards against gong 40 via the effect of spring 68 being let down, arm 92 of spring 82 is elastically deformed against its return force by pin 90, which pivots at the same time as hammer 38, such that said spring 82 then returns hammer 38 during the pause between the passage of two successive snugs 36 at the height of click 70 into a rest position in which said hammer 38 is at a distance from gong 40.

The timepiece according to the invention also includes a braking mechanism 94 for slowing down the rotational speed of drive wheel 64 when motor spring 44 unwinds. This braking mechanism 94 includes first of all a wheel 96 with wolf-teeth fixed to a square 98 of barrel shaft 50 and which co-operates via its outer toothing with a click 100. The teeth of wheel 96 push beak 102 of click 100 back when motor spring 44 is being wound, i.e. when said wheel 96 rotates anticlockwise. Conversely, when motor spring 44 is let down, beak 102 of click 100 clicks into the teeth of wolf-teeth wheel 96 and drives in rotation a wheel 104 onto which it is pivotally mounted. Thus, when motor spring 44 unwinds, click 100, meshed with the teeth of wheel 96, drives wheel 104 in rotation. This wheel 104 is the first wheel of a chain 106 regulating, by centrifugal force, the let down speed of motor spring 44. Advantageously, click 100 is held in elastic contact with wolf-teeth wheel 96 by means of a friction spring 108.

As already mentioned in the above description, a trigger mechanism 62 is disposed between striking work 22 and the clockwork movement in order to prevent said striking work 22 from operating before the end of the countdown. In other words, motor spring 44 will only be able to unwind after the end wheel set of striking work 22 has been released by the aforementioned trigger mechanism 62.

According to the invention, trigger mechanism 62 includes a holding member 110, advantageously a stone or jewel, which is housed in one of notches 112 arranged on end wheel set 42 of regulating chain 106 and stops the latter, such that it is possible to lock striking work 22 until a defined trigger moment. Preferably, stone 110 is fixedly mounted in a bolt whose holding force can be adjusted by means of an adjustable spring 116.

Figure 3:
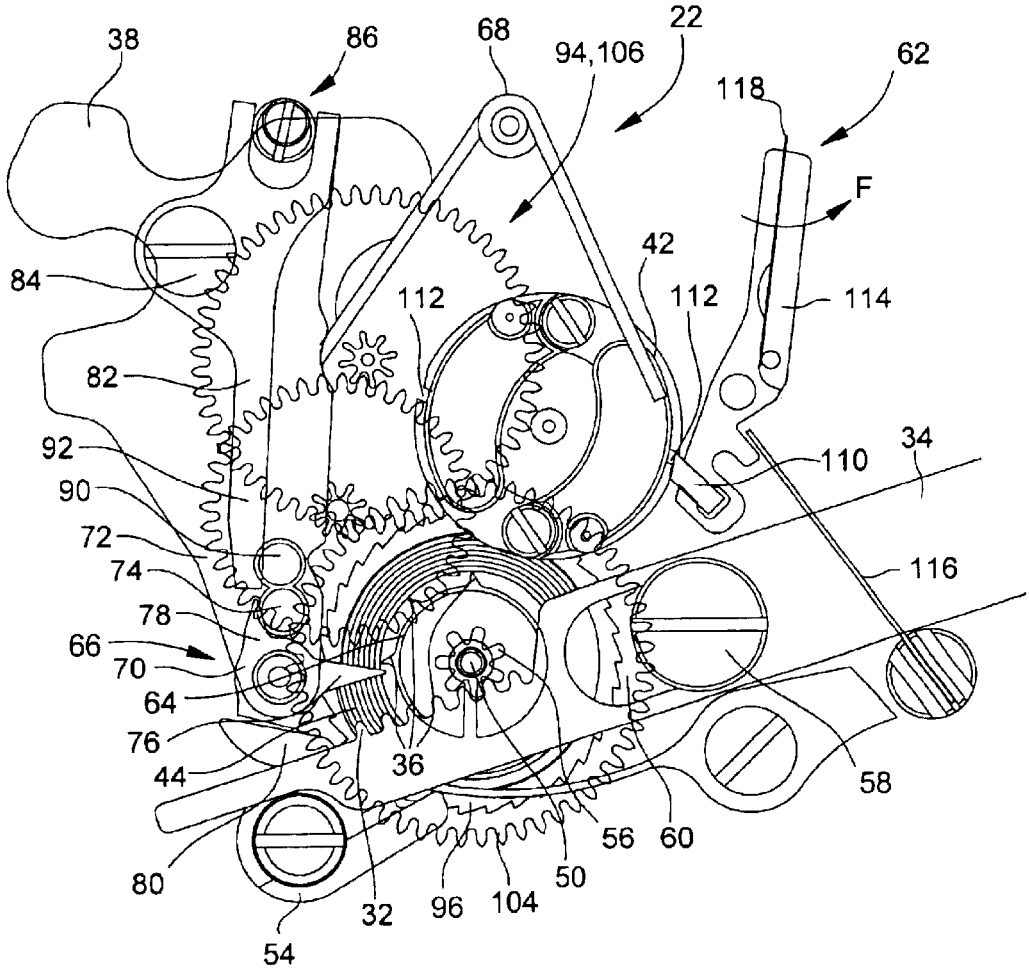
FIG. 3 is a larger scale plan view of the striking work shown in FIG. 2, not yet triggered.
Figure 4:
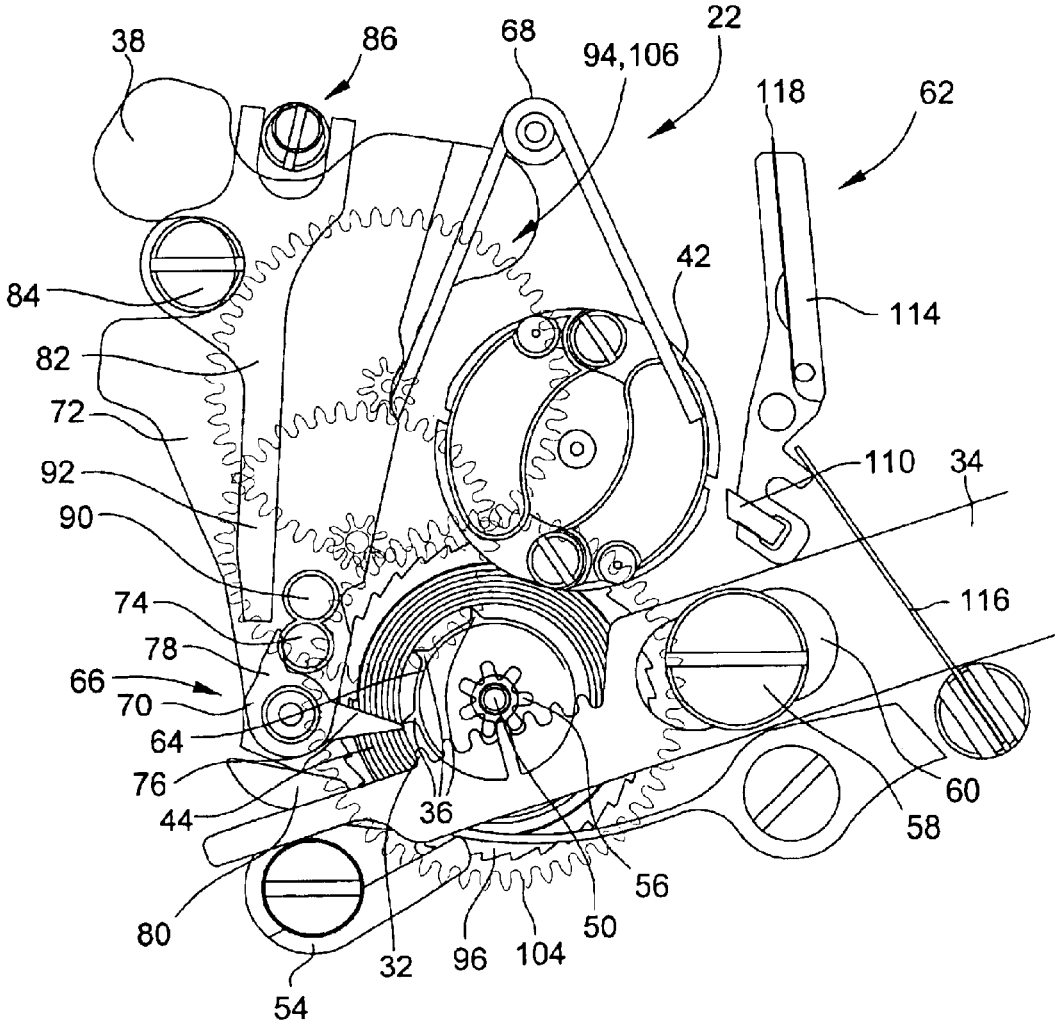
FIG. 4 is a similar view to that of FIG. 3 in which the striking work according to the invention has been triggered.
Figure 6:
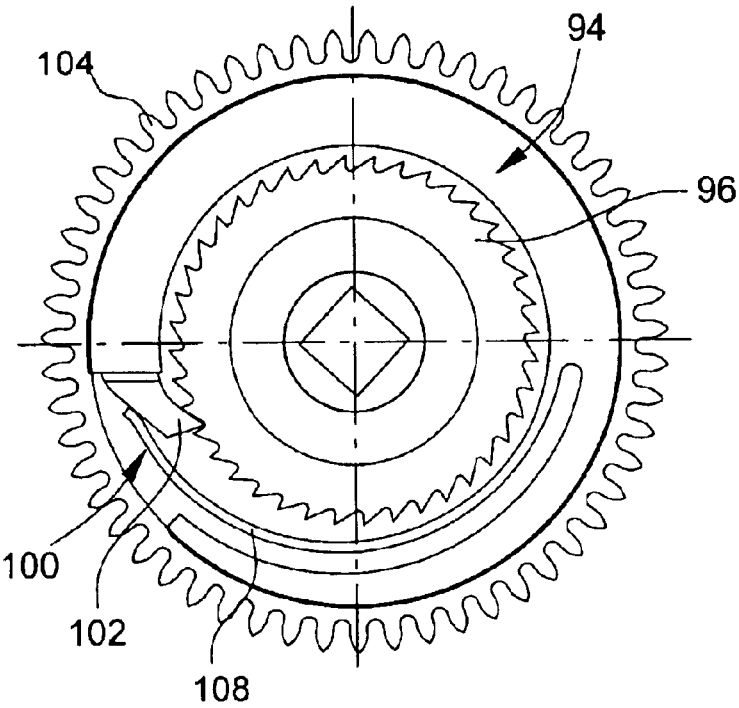
FIG. 6 is a plan view of a wheel with wolf-teeth which forms the first wheel of a regulating chain.
Figure 5:
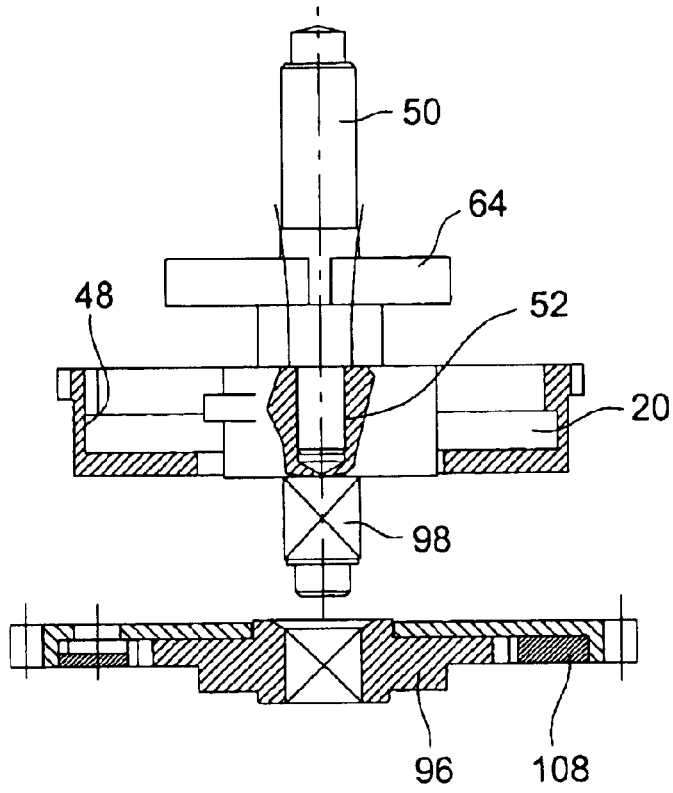
FIG. 5 is an elevation view of a part forming a barrel inside which is wound the motor spring, whose external turn is hooked to the barrel, and whose internal turn is secured to a barrel shaft.
Figure 7:
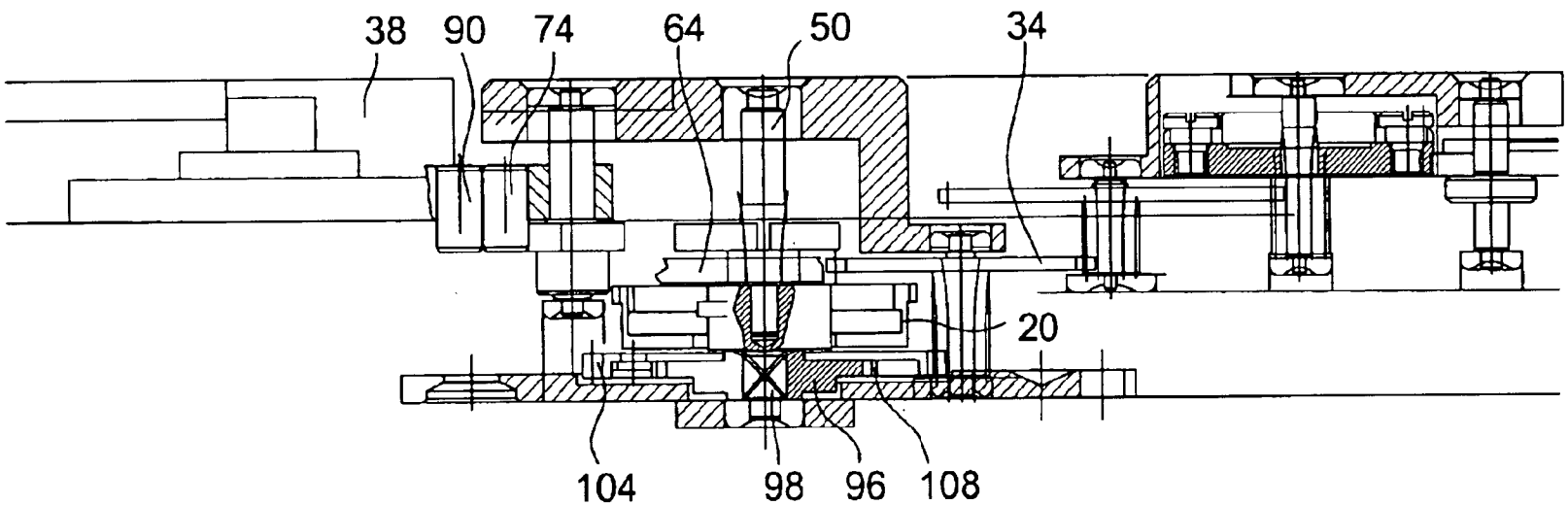
FIG. 7 is an elevation view of the whole alarm mechanism.

The trigger mechanism operates as follows. The period of time to be counted down by the countdown counter before the striking work is actuated is set by the person wearing watch 1 using crown 18, which is visible in FIG. 1. Next, motor spring 44 is wound by pressing on push-button 24. During the entire time that the time counter or timer counts down the time remaining before the striking work has to ring to indicate that the countdown has reached the end, or when the clockwork movement performs another function such as measuring the present time or a timing function, stone 110 is forced against end wheel set 42 of regulating chain 106 by spring 116 (see FIGS. 2 and 3). Conversely, when the time counter reaches the end of the countdown, an unlocking finger (not shown) connected to the clockwork movement via said time counter, actuates a control spring 118 of bolt 114 so as to pivot the latter in the direction of arrow F (see FIG. 4), such that stone 110 is released from notch 112 in which it was housed and releases end wheel set 42 of regulating chain 106, thus allowing motor spring 44 to unwind so that striking work 32 can ring.

It will be understood that winding bar 34 is free to move in a rectilinear manner between a rest position in which control and winding push-button 24 has not yet been actuated, and an end of travel position in which push-button 24 has been pushed in, which means that motor spring 44 is in the wound state. Winding bar 34 then gradually returns from its end of travel position to its rest position, aided by a return spring 120.

It goes without saying that the invention is not limited to the embodiments that have just been described, and that simple modifications and variants can be envisaged without departing from the scope of the present invention.

What is claimed is:

1. A timepiece including a clockwork movement for measuring in particular the time, and a striking work actuated by a barrel with a motor spring independent of the clockwork movement, said timepiece also including mechanical control means capable of being actuated manually to trigger the striking work wherein the barrel is wound by means of a winding bar that ends, at its free end, in a toothed sector or rack and is kinematically connected to a winding push-button on the one hand, and to the motor spring of said striking work, on the other hand.

2. A timepiece according to claim 1, wherein the barrel carries at least one snug, which actuates a strike hammer when the motor spring unwinds.

3. A timepiece according to claim 1, wherein the motor spring is wound inside the barrel, said motor spring being hooked via its outer turn to the barrel, and to a barrel shaft by its inner turn.

4. A timepiece according to claim 3, wherein the barrel is freely rotated when it is mounted so as to impart an initial tension to the motor spring, then it is stopped definitively after mounting by means of a holding member.

5. A timepiece according to claim 4, wherein the holding member is a click.

6. A timepiece according to claim 3, wherein the motor spring is wound via the winding bar, which meshes with a rack pinion forming the drive member for the striking work and which is fixedly mounted on the barrel shaft.

7. A timepiece according to claim 3, wherein a drive wheel mechanically coupled to the barrel shaft actuates a strike hammer, which strikes a gong when the striking work is triggered, such that the force of the motor spring is used solely for actuating the striking work.

8. A timepiece according to claim 7, wherein the drive wheel includes at least one snug which, when the motor spring unwinds, co-operates with a tipping mechanism causing the hammer to move back against the return force of a spring and, consequently, said hammer to move abruptly forwards against the gong.

9. A timepiece according to claim 8, wherein the tipping mechanism includes a click pivotally mounted on the lever of the hammer, said click being able to slide on the snug or snugs of the drive wheel when the motor spring is being wound, and being pivoted by said snugs when the motor spring is unwinding, said click then abutting against a pin secured to the hammer, to which it communicates its tipping movement.

10. A timepiece according to claim 9, wherein the click includes two teeth angularly spaced and rigidly connected to each other, the first tooth co-operating with the snugs of the drive wheel whereas the second tooth rests on the pin when the motor spring is let down or unwound.

11. A timepiece according to claim 8, wherein the click is held in elastic contact with the drive wheel by means of a holding spring.

12. A timepiece according to claim 7, wherein the hammer is returned to its rest position by a spring.

13. A timepiece according to claim 12, wherein the return spring is fixedly mounted at at least one point on the clockwork movement and is elastically deformed against its return force by a pin secured to the hammer when the latter strikes the gong, such that said spring returns the hammer during the pause into a rest position in which said hammer is at a distance from the gong.

14. A timepiece according to claim 3, wherein it includes a braking mechanism for slowing down the speed of drive wheel when the motor spring is unwinding.

15. A timepiece according to claim 14, wherein the braking mechanism includes a wheel with wolf-teeth fixed onto a square of the barrel shaft and which co-operates via its outer toothing with a click whose beak is pushed back by the teeth of the wheel when the motor spring is being wound, and which clicks into said teeth when the motor spring is being let down or unwound.

16. A timepiece according to claim 15, wherein the click is pivotally mounted on a wheel which it drives in rotation when the motor spring is let down or unwound.

17. A timepiece according to claim 15, wherein the wheel is the first wheel of a chain regulating, by centrifugal force, the unwinding speed of the motor spring.

18. A timepiece according to claim 15, wherein the click is held in elastic contact with the wolf-teeth wheel by means of a friction spring.

19. A timepiece according to claim 1, wherein a trigger mechanism inserted between the striking work and the clockwork movement prevents said striking work from operating before the end of the countdown.

20. A timepiece according to claim 19, wherein the trigger mechanism includes a holding member which is housed in a notch arranged on one of the wheels of the regulating chain such that it is possible to block the striking work function until a defined trigger moment.

21. A timepiece according to claim 20, wherein the holding member is a stone.

22. A timepiece according to claim 21, wherein the stone is fixedly mounted in a bolt whose holding force can be adjusted by means of an adjustable spring.

23. A timepiece according to claim 22, wherein during the time that the time counter or timer is counting down the time remaining before the striking work has to ring to indicate that the countdown has reached its end, the stone is forced against the end wheel set of the regulating chain by the spring and in that, when the time counter reaches the end of the countdown, an unlocking finger connected to the clockwork movement via said time counter actuates a control spring of the bolt so as to pivot the latter such that the stone is released from the notch in which it was housed and releases the end wheel set of the regulating chain, thus allowing the motor spring to unwind so that the striking work can ring.

24. A timepiece according to claim 2 wherein the winding bar is mobile rectilinearly between a rest position in which the control and winding push-button 9 has not yet been actuated, and an end of travel position in which the push-button has been pushed in and which corresponds to the wound state of the motor spring, the winding bar gradually returning from its end of travel position to its rest position as said motor spring unwinds, aided by the return force of a spring (120).

25. A timepiece according to claim 24, wherein the winding bar is guided in its rectilinear movement by two studs which penetrate respective oblong holes made in said bar.

* * * * *